US006997271B2

(12) United States Patent
Nichols et al.

(10) Patent No.: US 6,997,271 B2
(45) Date of Patent: Feb. 14, 2006

(54) DRILLING STRING TORSIONAL ENERGY CONTROL ASSEMBLY AND METHOD

(75) Inventors: Richard A. Nichols, Spring, TX (US); Bruce L. Taylor, Spring, TX (US); Larry G. Palmer, Spring, TX (US)

(73) Assignee: Strataloc Technology Products, LLC, Spring, TX (US)

( * ) Notice: Subject to any disclaimer, the term of this patent is extended or adjusted under 35 U.S.C. 154(b) by 0 days.

(21) Appl. No.: 10/849,624

(22) Filed: May 19, 2004

(65) Prior Publication Data

US 2004/0238219 A1 Dec. 2, 2004

Related U.S. Application Data

(60) Provisional application No. 60/474,355, filed on May 30, 2003, provisional application No. 60/485,333, filed on Jul. 7, 2003.

(51) Int. Cl.
*E21B 7/24* (2006.01)

(52) U.S. Cl. ..... 175/56; 175/24; 175/325.2

(58) Field of Classification Search ..... 175/320, 175/56, 325.2, 325.5, 24, 40, 57
See application file for complete search history.

(56) References Cited

U.S. PATENT DOCUMENTS

| | | | | |
|---|---|---|---|---|
| 3,232,362 | A * | 2/1966 | Cullen et al. | 175/104 |
| 3,805,606 | A * | 4/1974 | Stelzer et al. | 73/152.48 |
| 3,964,558 | A * | 6/1976 | Fogle | 175/107 |
| RE30,246 | E * | 4/1980 | Richter et al. | 175/65 |
| 4,386,666 | A * | 6/1983 | Crase et al. | 175/101 |
| 4,834,193 | A | 5/1989 | Leitko et al. | 175/19 |
| 5,323,852 | A * | 6/1994 | Cornette et al. | 166/51 |
| 5,738,178 | A * | 4/1998 | Williams et al. | 175/61 |
| 5,947,214 | A * | 9/1999 | Tibbitts | 175/276 |
| 6,129,160 | A | 10/2000 | Williams et al. | 175/107 |
| 6,325,163 | B1 | 12/2001 | Tibbitts | 175/57 |
| 6,338,390 | B1 | 1/2002 | Tibbitts | 175/56 |
| 6,540,033 | B1 * | 4/2003 | Sullivan et al. | 175/40 |
| 6,569,020 | B1 | 5/2003 | Falgout, Sr. | 464/157 |
| 6,571,886 | B1 | 6/2003 | Sullivan et al. | 175/40 |
| 6,571,888 | B1 | 6/2003 | Comeau et al. | 175/61 |
| 6,640,909 | B1 * | 11/2003 | Vandenberg et al. | 175/73 |
| 2001/0052428 | A1 * | 12/2001 | Larronde et al. | 175/61 |
| 2004/0112640 | A1 * | 6/2004 | Hay et al. | 175/26 |
| 2005/0034895 | A1 * | 2/2005 | Sawyer | 175/45 |

* cited by examiner

*Primary Examiner*—David Bagnell
*Assistant Examiner*—Daniel P Stephenson
(74) *Attorney, Agent, or Firm*—Kenneth L. Nash

(57) ABSTRACT

The present invention provides a torsional energy control assembly and method for eliminating slip-stick and/or drill bit oscillations comprising axial and/or rotational oscillations. In one preferred embodiment, the assembly permits slippage between an upper portion of the drilling string and a lower portion of a drill string. The rotational control assembly may be installed at any desired position in the drill string. The rotational control assembly could also be utilized as a component of other drilling mechanisms such as a downhole drilling motor. The rotational control permits slippage while drilling for a selected time or selected rotational distance or other criteria to thereby release torsional energy in the drilling string which otherwise may produce damaging slip-stick torsional oscillations such as slip-stick. The rotational control assembly may, in one embodiment, comprise an on-off clutch whereby torque is either substantially completely transmitted or substantially not transmitted through the assembly for brief periods.

26 Claims, 13 Drawing Sheets

MICROSOFT EXCEL - PROGRAM134

FILE EDIT VIEW INSERT FORMAT TOOLS DATA WINDOW HELP

ARIAL 10

C11 = =C10*30

| | A | B | C | D | E | F | G | H |
|---|---|---|---|---|---|---|---|---|
| 1 | DRILLSTRING #1 | | | | DRILLSTRING #2 | | | |
| 2 | CHANGE ONLY VALUES WITH * | | | | CHANGE ONLY VALUES WITH * | | | |
| 3 | DRILL PIPE DRAG TORQUE | | 1650* | | DRILL PIPE DRAG TORQUE | | 1650 | |
| 4 | BHA DRAG TORQUE | | 2000* | | BHA DRAG TORQUE | | 2000* | |
| 5 | BIT TORQUE | | 750* | | BIT TORQUE | | 750 | |
| 6 | STARTING TORQUE IN FOOT LBS | INPUT | 4400 | | STARTING TORQUE IN FOOT LBS | SAME | 4400 | |
| 7 | TOP DRILLPIPE SECTION | | | | TOP DRILLPIPE SECTION | | | |
| 8 | OUTSIDE DIAMETER | FROM 1DP | 5 | | OUTSIDE DIAMETER | SAME | 5 | |
| 9 | INSIDE DIAMETER | FROM 1DP | 4.276 | | INSIDE DIAMETER | SAME | 4.276 | |
| 10 | NUMBER OF JOINTS | INPUT | 320* | | NUMBER OF JOINTS | CALC | 317.93 | |
| 11 | LENGTH THIS SECTION IN FT | | 9600 | | LENGTH THIS SECTION IN FT | | 9538 | |
| 12 | SECOND DRILLPIPE SECTION | | | | SECOND DRILLPIPE SECTION | | | |
| 13 | OUTSIDE DIAMETER | FROM 2DP | 5 | | OUTSIDE DIAMETER | SAME | 5 | |
| 14 | INSIDE DIAMETER | FROM 2DP | 4.276 | | INSIDE DIAMETER | SAME | 4.276 | |
| 15 | NUMBER OF JOINTS | INPUT | 20* | | NUMBER OF JOINTS | SAME | 320 | |
| 16 | LENGTH THIS SECTION IN FT | | 600 | | LENGTH THIS SECTION IN FT | | 600 | |
| 17 | HEVI-WATE DRILLPIPE SECTION | | | | HEVI-WATE DRILLPIPE SECTION | | | |
| 18 | OUTSIDE DIAMETER | INPUT | 5.5* | | OUTSIDE DIAMETER | SAME | 5.5 | |
| 19 | INSIDE DIAMETER | INPUT | 4.67* | | INSIDE DIAMETER | SAME | 4.67 | |
| 20 | NUMBER OF JOINTS | INPUT | 6* | | NUMBER OF JOINTS | SAME | 6 | |
| 21 | LENGTH THIS SECTION IN FT | | 180 | | LENGTH THIS SECTION IN FT | | 180 | |
| 22 | HEVIPAC SECTION | | | | DRILL COLLAR SECTION | | | |
| 23 | OUTSIDE DIAMETER | INPUT | 10.000* | | OUTSIDE DIAMETER | INPUT | 8.500* | |
| 24 | INSIDE DIAMETER OF OUTER TUBE | CALC | 8.000 | | INSIDE DIAMETER | INPUT | 2.500* | |
| 25 | NUMBER OF JOINTS | INPUT | 4 | | NUMBER OF JOINTS | INPUT | 6* | |

TOOL 1DP 2DP DR.ST DATA RPM

READY

START MICROSOFT EXCEL 9:43 PM

FIG. 7

MICROSOFT EXCEL - PROGRAM134

FILE EDIT VIEW INSERT FORMAT TOOLS DATA WINDOW HELP

C3

| | A | B | C | D | E | F |
|---|---|---|---|---|---|---|
| 1 | BHA 1 | | | BHA 2 | | |
| 2 | CHANGE ONLY VALUES WITH * | | | CHANGE ONLY VALUES WITH * | | |
| 3 | DRILL PIPE INERTIA | .00869182 | | DRILL PIPE INERTIA | .00869182 | |
| 4 | HEVI WT DP INERTIA | .04453414 | | HEVI WT DP INERTIA | .04453414 | |
| 5 | HEVI PAC INERTIA | .88896612 | | DRILL COLLAR INERTIA | .47010817 | |
| 6 | INERTIA FIRST BHA X10-9 | .94219209 | | INERTIA SECOND BHA | .52333415 | |
| 7 | TORSIONAL CONSTANT | 230.3463 | | TORSIONAL CONSTANT | 231.6355 | |
| 8 | STARTING TORQUE | 4400 | | STARTING TORQUE | 4400 | |
| 9 | INITIAL WINDUP | 19.1016747 | | INITIAL WINDUP | 18.995363 | |
| 10 | MUD WEIGHT IN LBS/GALLON | 12* | | MUD WEIGHT IN LBS/GALLON | 12 | |
| 11 | AVAILABLE WOB FROM HEVIPAC | 29,977 | | AVAILABLE WOB FROM DC'S | 26,732 | |
| 12 | BREAK AWAY RPM | 30* | TOTAL DEGREES | BREAK AWAY RPM | 30* | TOTAL DEGREES |
| 13 | BREAK AWAY TORQUE | 350.00* | 223.05 | BREAK AWAY TORQUE | 350.00* | 0.00 |
| 14 | DRIVE RPM | 120* | NO. OF REL'S | DRIVE RPM | 120* | NO. OF REL'S |
| 15 | RESOLUTION/ SEC | 0.050* | 7 | RESOLUTION/ SEC | 0.050* | 0.00 |
| 16 | INTRODUCED LOAD IN FT LBS | 600* | AVER RELEASE | INTRODUCED LOAD IN FT LBS | 600* | AVER RELEASE |
| 17 | AXIAL DAMPING % | 0.40* | 31.8637 | AXIAL DAMPING % | 0.40* | #DIV/0! |
| 18 | ACC/ DEC DAMPING % | 0.00* | | ACC/ DEC DAMPING % | 0.00* | |
| 19 | PRESET RELEASE DEG 1=ON | 0 | | PRESET RELEASE DEG 1=ON | 0 | |
| 20 | ACCELERATION CAP R/S | 2.50* | | ACCELERATION CAP R/S | 2.50* | |
| 21 | TOOL DYNAMICS 1=ON | 1* | | TOOL DYNAMICS 1=ON | 0* | |
| 22 | DEGREES OF RELEASE TD=0 | 40 | | DEGREES OF RELEASE TD=0 | 40 | |
| 23 | ONE CYCLE RESET 1=ON | 0* | | ONE CYCLE RESET 1=ON | 0* | |

TOOL/1DP/2DP/DR.ST/DATA/RPM/

READY

START MICROSOFT EXCEL 9:43 PM

FIG. 8

MICROSOFT EXCEL - PROGRAM134

FILE EDIT VIEW INSERT FORMAT TOOLS DATA WINDOW HELP

A3 =1=SELECT>>>

| | A | B | C | D | E | F | G | H | I | J | K | L | M |
|---|---|---|---|---|---|---|---|---|---|---|---|---|---|
| 1 | PROPER SELECTION MADE? | | SECOND DRILL PIPE (CHOOSE ONE ONLY) | | | | | | | | | | |
| 2 | YES | SELECT | PIPE OD INC | NOMINAL PIPE WEIGHT LB./FT | PIPE MATERIAL GRADE | PIPE ID | UPSET STYLE | APPROX ACTUAL WEIGHT LB/FT | WALL THICK-NESS | CONN SIZE | CONN TYPE | TOOL JOINT OD | TOOL JOINT BORE |
| 33 | 1=SELECT>>> | | | 20 | E-75 | 3.640 | IEU | 22.33 | 0.430 | API | NC 46 | 6 1/4 | 3 |
| 34 | 1=SELECT>>> | | | 20 | X-95 | 3.640 | IEU | 22.83 | 0.430 | API | NC 46 | 6 1/4 | 3 |
| 35 | 1=SELECT>>> | | | 20 | G-105 | 3.640 | IEU | 22.62 | 0.430 | API | NC 46 | 6 1/4 | 3 |
| 36 | 1=SELECT>>> | | | 20 | G-105 | 3.640 | IEU | 23.03 | 0.430 | API | NC 46 | 6 1/4 | 2 1/ |
| 37 | 1=SELECT>>> | | | 20 | G-135 | 3.640 | IEU | 23.2 | 0.430 | API | NC 46 | 6 1/4 | 2 1/ |
| 38 | 1=SELECT>>> | 1 | 5 | 19.5 | E-75 | 4.276 | IEU | 21.54 | 0.362 | API | NC 50 | 6 5/8 | 4 |
| 39 | 1=SELECT>>> | | | 19.5 | X-95 | 4.276 | IEU | 22.06 | 0.362 | API | NC 50 | 6 1/2 | 3 1/ |
| 40 | 1=SELECT>>> | | | 19.5 | X-95 | 4.276 | IEU | 22.07 | 0.362 | API | NC 50 | 6 5/8 | 3 1/ |
| 41 | 1=SELECT>>> | | | 19.5 | G-105 | 4.276 | IEU | 22.32 | 0.362 | API | NC 50 | 6 5/8 | 3 1/ |
| 42 | 1=SELECT>>> | | | 19.5 | S-135 | 4.276 | IEU | 22.76 | 0.362 | API | NC 50 | 6 5/8 | 3 |
| 43 | 1=SELECT>>> | | | 25.6 | E-75 | 4.000 | IEU | 27.6 | 0.500 | API | NC 50 | 6 5/8 | 3 1/ |
| 44 | 1=SELECT>>> | | | 25.6 | X-95 | 4.000 | IEU | 28.33 | 0.500 | API | NC 50 | 6 5/8 | 3 |
| 45 | 1=SELECT>>> | | | 25.6 | G-105 | 4.000 | IEU | 28.54 | 0.500 | API | NC 50 | 6 5/8 | 3 |
| 46 | 1=SELECT>>> | | 5.5 | 21.9 | E-75 | 4.778 | IEU | 23.98 | 0.361 | 5 1/2 | API FH | 7 | 4 |
| 47 | 1=SELECT>>> | | | 21.9 | X-95 | 4.778 | IEU | 25.22 | 0.361 | 5 1/2 | API FH | 7 1/4 | 4 |

TOOL/1DP/2DP/DR,ST/DATA/RPM/

READY

SUM=500258.0258

START MICROSOFT EXCEL 9:43 PM

FIG. 9

MICROSOFT EXCEL - PROGRAM134

FILE EDIT VIEW INSERT FORMAT TOOLS DATA WINDOW HELP

ARIAL 10 B I U

B7 =

| | A | B | C | D | E | F | G | H | I | J | K | L | M |
|---|---|---|---|---|---|---|---|---|---|---|---|---|---|
| 31 | 1=SELECT>>> | | | 16.6 | G-105 | 3.826 | IEU | 18.79 | 0.337 | API | NC 46 | 6 1/4 | 3 |
| 32 | 1=SELECT>>> | | | 16.6 | S-135 | 3.826 | IEU | 19.01 | 0.337 | API | NC 46 | 6 1/4 | 3 |
| 33 | 1=SELECT>>> | | | 20 | E-75 | 3.640 | IEU | 22.33 | 0.430 | API | NC 46 | 6 1/4 | 3 |
| 34 | 1=SELECT>>> | | | 20 | X-95 | 3.640 | IEU | 22.83 | 0.430 | API | NC 46 | 6 1/4 | 3 |
| 35 | 1=SELECT>>> | | | 20 | G-105 | 3.640 | IEU | 22.62 | 0.430 | API | NC 46 | 6 1/4 | 3 |
| 36 | 1=SELECT>>> | | | 20 | G-105 | 3.640 | IEU | 23.03 | 0.430 | API | NC 46 | 6 1/4 | 2 1/ |
| 37 | 1=SELECT>>> | | | 20 | G-135 | 3.640 | IEU | 23.2 | 0.430 | API | NC 46 | 6 1/4 | 2 1/ |
| 38 | 1=SELECT>>> | 1 | 5 | 19.5 | E-75 | 4.276 | IEU | 21.54 | 0.362 | API | NC 50 | 6 5/8 | 4 |
| 39 | 1=SELECT>>> | | | 19.5 | X-95 | 4.276 | IEU | 22.06 | 0.362 | API | NC 50 | 6 1/2 | 3 1/ |
| 40 | 1=SELECT>>> | | | 19.5 | X-95 | 4.276 | IEU | 22.07 | 0.362 | API | NC 50 | 6 5/8 | 3 1/ |
| 41 | 1=SELECT>>> | | | 19.5 | G-105 | 4.276 | IEU | 22.32 | 0.362 | API | NC 50 | 6 5/8 | 3 1/ |
| 42 | 1=SELECT>>> | | | 19.5 | S-135 | 4.276 | IEU | 22.76 | 0.362 | API | NC 50 | 6 5/8 | 3 |
| 43 | 1=SELECT>>> | | | 25.6 | E-75 | 4.000 | IEU | 27.6 | 0.500 | API | NC 50 | 6 5/8 | 3 1/ |
| 44 | 1=SELECT>>> | | | 25.6 | X-95 | 4.000 | IEU | 28.33 | 0.500 | API | NC 50 | 6 5/8 | 3 |
| 45 | 1=SELECT>>> | | | 25.6 | G-105 | 4.000 | IEU | 28.54 | 0.500 | API | NC 50 | 6 5/8 | 3 |
| 46 | 1=SELECT>>> | | 5.5 | 21.9 | E-75 | 4.778 | IEU | 23.98 | 0.361 | 5 1/2 | API FH | 7 | 4 |
| 47 | 1=SELECT>>> | | | 21.9 | X-95 | 4.778 | IEU | 25.22 | 0.361 | 5 1/2 | API FH | 7 1/4 | 4 |
| 48 | 1=SELECT>>> | | | 21.9 | G-105 | 4.778 | IEU | 25.5 | 0.361 | 5 1/2 | API FH | 7 1/4 | 3 1/ |
| 49 | 1=SELECT>>> | | | 21.9 | S-135 | 4.778 | IEU | 25.5 | 0.361 | 5 1/2 | API FH | 7 1/4 | 3 1/ |
| 50 | 1=SELECT>>> | | | 21.9 | S-135 | 4.778 | IEU | 26.66 | 0.361 | 5 1/2 | API FH | 7 1/2 | 3 |
| 51 | 1=SELECT>>> | | | 24.7 | E-75 | 4.670 | IEU | 26.52 | 0.361 | 5 1/2 | API FH | 7 | 4 |
| 52 | 1=SELECT>>> | | | 24.7 | X-95 | 4.670 | IEU | 28.01 | 0.500 | 5 1/2 | API FH | 7 1/4 | 3 1/ |
| 53 | 1=SELECT>>> | | | 24.7 | G-105 | 4.670 | IEU | 28.01 | 0.500 | 5 1/2 | API FH | 7 1/4 | 3 1/ |

TOOL 1DP 2DP DR,ST DATA RPM

READY

START MICROSOFT EXCEL 9:43 PM

FIG. 10

DRILLING STRING TORSIONAL ENERGY CONTROL ASSEMBLY AND METHOD

The benefit of U.S. Provisional Patent Application No. 60/474,355, filed May 30, 2003, and U.S. Provisional Patent Application No. 60/485,333, filed Jul. 7, 2003, are hereby claimed, and are hereby incorporated by reference.

TECHNICAL FIELD

The present invention relates generally to drilling wellbores for oil, gas, and the like. More particularly, the present invention relates to assemblies and methods operable for rapidly connecting and disconnecting upper and lower drill string sections to greatly enhance drilling performance by preventing drill bit oscillations.

DISCUSSION OF THE BACKGROUND ART

It has been said by top industry experts that slip-stick is the single greatest problem for modem oil and gas well drilling. Other industry technical experts have said that axial bit vibrations and/or bit bounce comprise the most significant problem in oil and gas well drilling. According to studies of these problems made by the inventors, which studies comprise insights into these problems that are part of the present invention, it has been concluded and demonstrated in computer simulations, as discussed hereinafter, that the two problems are closely related and, in fact, are both directly synonymous with drill string torsional vibrations or oscillations.

Whenever the drill bit is rotated for drilling into a formation, the drill string has torsional windup or torsional potential energy, just as a torsional spring might have when torque is applied thereto. When drilling, it is highly desirable that this torsional windup or potential energy be a constant value based on the torsional constant of the drill string, and not a varying or oscillating amount. The drill pipe diameter and well depth are significant factors in determining the drill string torsional spring constant.

The windup that occurs is basically stored elastic potential energy. The drill string torsional energy may be altered by bit weight, bore hole friction or cutting conditions whereby more or less windup is induced into the drill string. The drill bit speed is reduced proportionally by an increase in torque. If the torque increases enough, the drill bit stops rotation completely. However, since rotational power is still being applied to the drill string for drilling, the drill string continues to windup (increasing elastic potential energy). When the windup (stored elastic potential energy) is great enough to overcome the increase in torque which stopped the bit, the stored up potential energy becomes kinetic energy which accelerates the drill string, BHA and the drill bit. The drill string, BHA and drill bit accelerate rapidly and will accelerate faster than, for instance the top drive input rpm, due to the stored elastic potential energy that is now much more than is required to turn the drill string, BHA and drill bit at the original torque (RPM).

The bit, BHA and drill string speed (RPM) increases until it rotates faster than the input speed (RPM) from the original drive causing the drill string to unwind more than required. The excessive unwinding releases more stored elastic potential energy than what is required to drive the drill bit at the original torque (RPM) and starts harmonic motions, such as but not limited to axial movements (bit bounce) and Slip-Stick (Stick-Slip).

The windup and unwinding causes the entire drill string to shorten and then lengthen. The speed changes from near zero rpm or zero rpm to speeds greater than the drill string drive constant input speed, thereby inducing full-blown slip-stick (stick-slip) and bit bounce. In the past, the cycles torsional oscillations continue until the driller removes WOB or there are connection failures.

Drill string torsional vibrations occur frequently during drilling. In very general terms, torsional stress is caused when one end of the drill string is twisted while the other end is held fixed or is twisted in the opposite direction. The long length of the drill string will normally store a significant amount of torsional energy when drilling. When torsional vibrations become severe, they can escalate into slip-stick oscillations whereby the bit may briefly stop turning or at least slow down until sufficient torque is developed at the bit to overcome static friction. When the stalled bit breaks free, it may do so at rotational speeds from to two to ten times the surface rotational speed. For example, when drilling at 200 rpm, slip-stick variations may produce drill bit rotational rpm variations between zero and 2000 rpm.

As discussed above, the accompanying twisting and untwisting of the drill string produces changes in the axial length of the drill string. Because modern PDC cutting elements of bits have a very short length and, ideally, must be held in constant close contact with the surface to be cut for maximum cutting effects, even small axial changes in the length of the drill string can significantly impede drilling progress and can cause bit bounce.

Moreover, torsional slip-stick is often regarded as one of the most damaging moues of vibration. The fluctuating torques in the drill-string are difficult to control without repeatedly pausing drilling. Torsional slip-stick almost invariably causes damage to the bit or drill-string. Even small amplitude slip-stick vibrations are thought to be a major cause of bit wear.

Torsional vibrations can be set off by torque fluctuations which may occur through changes in torque applied to or by the drill string which may arise for many reasons. As non-limiting examples, changes in torque may occur due to changes in the lithology, frictional forces along the well bore, changes in bit weight and/or stabilizers sticking in soft formations. It will be understood that large amounts of torsional energy will be stored in the drill string in response to applying the necessary torque for rotating the drill bit to cut through the formation. Torsional vibrations also affect the borehole and may produce a twisted borehole that becomes the source for additional torque. Thus, the problem of torsional vibrations is self-reinforcing. For many reasons, it is desirable to drill a straighter hole with reduced spiraling effects along the desired drilling path and with fewer washed out sections. For instance, it has been found that tortuosity, or spiraling effects frequently produced in the wellbore during drilling, are associated with degraded bit performance, bit whirl, an increased number of drill string trips, decreased reliability of MWD (measurement while drilling) and LWD (logging while drilling) due to the vibrations generally associated therewith, increased likelihood of losing equipment in the hole, increased circulation and mud problems due to the troughs along the spiraled wellbore, increased stabilizer wear, decreased control of the direction of drilling, degraded logging tool response due to hole variations including washouts and invasion, decreased cementing reliability due to the presence of one or more elongated troughs, clearance problems for gravel packing screens, decreased ROP (rate or speed of drilling penetration), and many other problems.

When drilling wells, it is highly desirable to drill the well as quickly as possible to limit the costs. It has been estimated that doubling the present day rate of drilling would result in cost savings to the oil industry of from two hundred to six hundred million dollars per year. This estimate may be conservative.

During the drilling of a well, considerable time is lost due to the need to trip the drill string. The drill string is removed from the wellbore for any of various reasons, e.g., to replace the drill bit. Reducing the number of drill string trips, especially in deep wells where removal and replacement of the drilling string takes considerable time, would greatly reduce drilling rig daily rental costs.

While the design of drill bits has often been the chief focus in the prior art to reduce many of the problems discussed above, some efforts have been made to improve other aspects of the bottom hole assembly. The typical bottom hole assembly includes a plurality of heavy weight drill collars. The typical steel heavy weight collars are relatively inexpensive and durable. However, due to their size and construction, prior art weight collars are unbalanced to some degree and tend to introduce variations. Moreover, even if they were perfectly balanced, the heavy weight collars have a buckling point and tend to bend up to this point during the drilling process. The result of imbalanced heavy weight collars and the bending of the overall downhole assembly produces a flywheel effect with an imbalance therein that may easily cause the drill bit to whirl, vibrate, and/or lose contact with the wellbore face in the desired drilling direction.

Efforts have also been made to make heavier drilling collars. For instance, it has been attempted to increase the diameter of steel drill collars to provide increased weight adjacent the drill bit. However, this then decreases the annular space between the higher diameter steel drill collars and the wall of the bore hole. The decrease in annular space creates a significant washout of the hole due to the necessarily higher velocity mud flow through a smaller annulus, especially in uncompacted formations. The inventors have provided improved drilling collars which result in many benefits as per U.S. Patent Application No. 60/442,737, which is incorporated herein by reference. However, even with a significant increase in weight directly above the bit as taught by the inventors therein, the effects of slip-stick are reduced but may not be stopped altogether as can be demonstrated by the computer program simulation developed by the inventors and discussed herein. Examples of utilizing the improved drilling collars as compared to standard drilling collars under conditions which may cause slip stick are provided hereinafter.

An article from *Offshore Magazine*, issued August 2001, written by Chen et al., entitled "Wellbore design: How long bits improve wellbore micro-tortuosity in ERD operations," discloses tortuosity as one of the critical factors in extended reach well operations, having two components: macro- and micro-tortuosity. The effects include high torque and drag, poor hole cleaning, drill string buckling, and loss of available drilled depth, among other negative conditions. A new drilling system using long gauge bits significantly reduces hole spiraling, one form of micro-tortuosity, which is intended by use of the drill bit design to improve many facets of the drilling operation.

The above cited prior art does not provide a reliable means for preventing slip-stick during drilling. Consequently, there remains a need to provide an improved downhole assembly to perform this function. Those of skill in the art will appreciate the present invention which addresses the above problems and other significant problems.

SUMMARY OF THE INVENTION

Accordingly, it is an objective of the present invention to provide an improved drilling assembly and method.

An objective of one possible embodiment of the present invention is to provide an improved rotational control assembly and method.

An objective of another possible embodiment is to provide faster drilling ROP (rate of penetration), longer bit life, reduced stress on drill string joints, truer gage borehole, improved circulation, improved cementing, improved lower noise MWD and LWD, improved wireline logging accuracy, improved screen assembly running and installation, fewer bit trips, reduced or elimination of tortuosity, reduced or elimination of drill string buckling, reduced hole washout, improved safety, and/or other benefits.

Another objective of yet another possible embodiment of the present invention may comprise combining one or more or several or all of the above objectives with or without one or more additional objectives, features, and advantages as disclosed hereinafter.

These and other objectives, features, and advantages of the present invention will become apparent from the drawings, the descriptions given herein, and the appended claims. However, it will be understood that the above-listed objectives, features, and advantages of the invention are intended only as an aid in understanding aspects of the invention, and are not intended to limit the invention in any way, and therefore do not form a comprehensive or restrictive list of objectives, and/or features, definitions, and/or advantages of the invention.

Accordingly, the present invention provides a method for controlling rotational oscillations of a drill bit while drilling. The drill bit is mounted to a drilling string which comprises a plurality of interconnected tubulars. The present invention may comprise one or more steps such as, for instance, installing a rotational control assembly in the drilling string between a lower tubular of the drilling string and an upper tubular of the drilling string. The lower and/or upper tubulars could be any type of tubular connection as may be found on a drill bit, mud motor, drill pipe, bottom hole assembly, heavy weight tubular, or the like. Selectively transferring torque between the lower tubular portion of the drilling string and the upper tubular of the drilling string during a drilling operation, and selectively permitting slippage between the upper tubular of the drilling string and the lower tubular of the drilling string during the drilling operation to thereby dampen the rotational oscillations. The method may further comprise activating the rotational control assembly to permit the slippage in response to a selected amount of acceleration of the drill bit.

The method may further comprise hydraulicly releasing a rotational locking mechanism to produce a selected amount of the rotational slippage. Other steps may comprise providing an electronic control for activating the rotational control assembly to permit the rotational slippage and/or programming the electronic control for a selectable amount of slippage and/or controlling movement one or more hydraulic pistons.

The present invention provides an assembly for permitting rotational slippage between a lower portion of a drill string and an upper tubular of the drill string during drilling operations involving drilling with a drill to thereby release torsional energy from the drill string. The assembly may comprise one or more elements such as, for instance, a tubular housing for connecting between the lower portion of the drill string and the upper portion of the drill string and/or one or more moveable members within the tubular housing for controlling torque transfer between the lower portion of the drill string and the upper portion of the drill string and/or a control for controlling the one or more moveable members.

The downhole may further comprise a sensor for sensing a selected type of movement of the drill bit wherein the sensor is sensitive to a programmable amount of acceleration movement of the drill bit. In one embodiment, the rotational slippage may be activated in response to acceleration but before a selected rotational speed occurs to thereby release more torsional energy. For instance, it may be desirable to release the torsional energy before the drilling bit reaches the drilling driving rotational speed. The one or more moveable members comprise one or more hydraulic pistons controlled by one or more valves.

The present invention may also comprise a computer simulation of the effect of activating a rotational control mounted in a drilling string where the rotational control may be operable for selectively transferring torque between tubulars in the drilling string, such as with an on-off clutch type mechanism or a variable control. The method of the computer simulation may comprise one or more steps such as, for instance, providing parameter inputs for inputting drill string parameters describing the drilling string, providing one or more rotational control activation parameter for inputting conditions under which the rotational control is activated, and providing one or more outputs related to torsional oscillations of a drill bit of the drilling string. The method may also comprise plotting drill bit movement versus time wherein the rotational control is activated to permit slippage between the tubulars in the drilling string to dampen the torsional oscillations. For instance, the drill string length, weight, and so forth may be entered. The torque change such as a 600 ft-lb load may be introduced to see whether this initiates torsional vibrations. The particular timing for activating the rotational control, e.g., on-off clutch, may be tested in any desired way for any acceleration, rotational speed, or any combination of such parameters. In another embodiment, a method is provided which may comprise one or more steps such as, for instance, installing a clutch assembly in the drilling string between a lower tubular of the drilling string and an upper tubular of the drilling string and/or selectively engaging the clutch to transfer torque between the lower tubular portion of the drilling string and the upper tubular of the drilling string during a drilling operation and/or selectively disengaging the clutch to permit slippage between the upper tubular of the drilling string and the lower tubular of the drilling string during the drilling operation to thereby dampen the drill bit oscillations.

The method may further comprise sensing movement of the drill bit which indicates the drill bit oscillations are likely to occur. The method may further comprise performing the step of selectively disengaging in response to said step of sensing.

The method may further comprise selectively partially disengaging or engaging the clutch to permit some slippage but also to transfer torque but not all torque.

BRIEF DESCRIPTION OF DRAWINGS

For a further understanding of the nature and objects of the present invention, reference should be had to the following detailed description, taken in conjunction with the accompanying drawings, in which like elements may be given the same or analogous reference numbers and wherein:

FIG. 7 is an input page for a computer simulation showing the option for testing two or more different drill strings simultaneously;

FIG. 8 is an input page for a computer simulation showing various input factors such as the bottom hole assembly details , mud weight, and other factors;

FIG. 9 and FIG. 10 show some details of individual pipes for the drill string which can be input or selected for the simulated drill string from a wide variety of drill pipe;

While the present invention will be described in connection with presently preferred embodiments, it will be understood that it is not intended to limit the invention to those embodiments. On the contrary, it is intended to cover all alternatives, modifications, and equivalents included within the spirit of the invention.

GENERAL DESCRIPTION AND PREFERRED MODES FOR CARRYING OUT THE INVENTION

Figure 1:
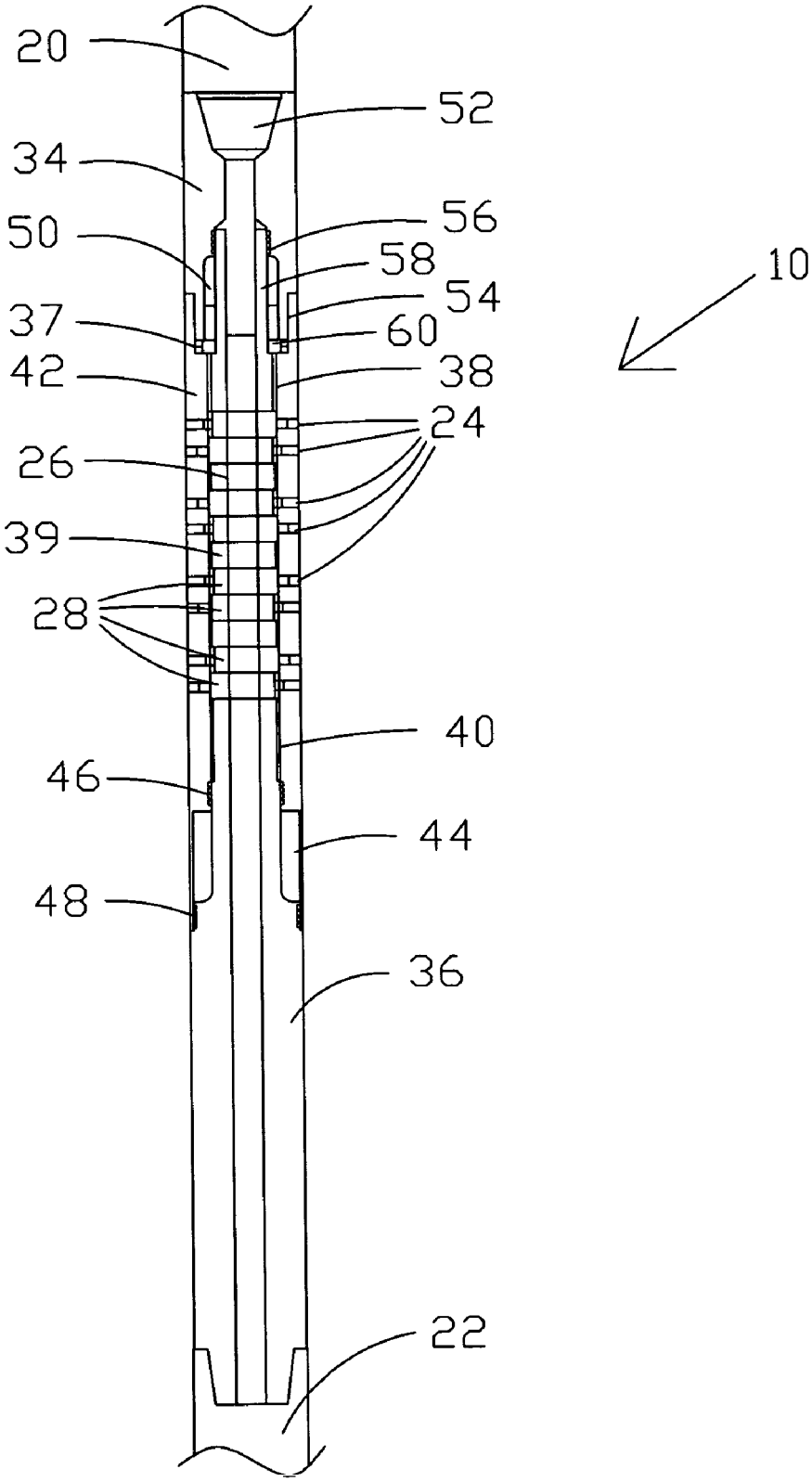
FIG. 1 is an elevational view, in cross-section, of a rotational control assembly for controlling drilling string torsional energy in accord with one possible embodiment of the present invention.
Figure 2:
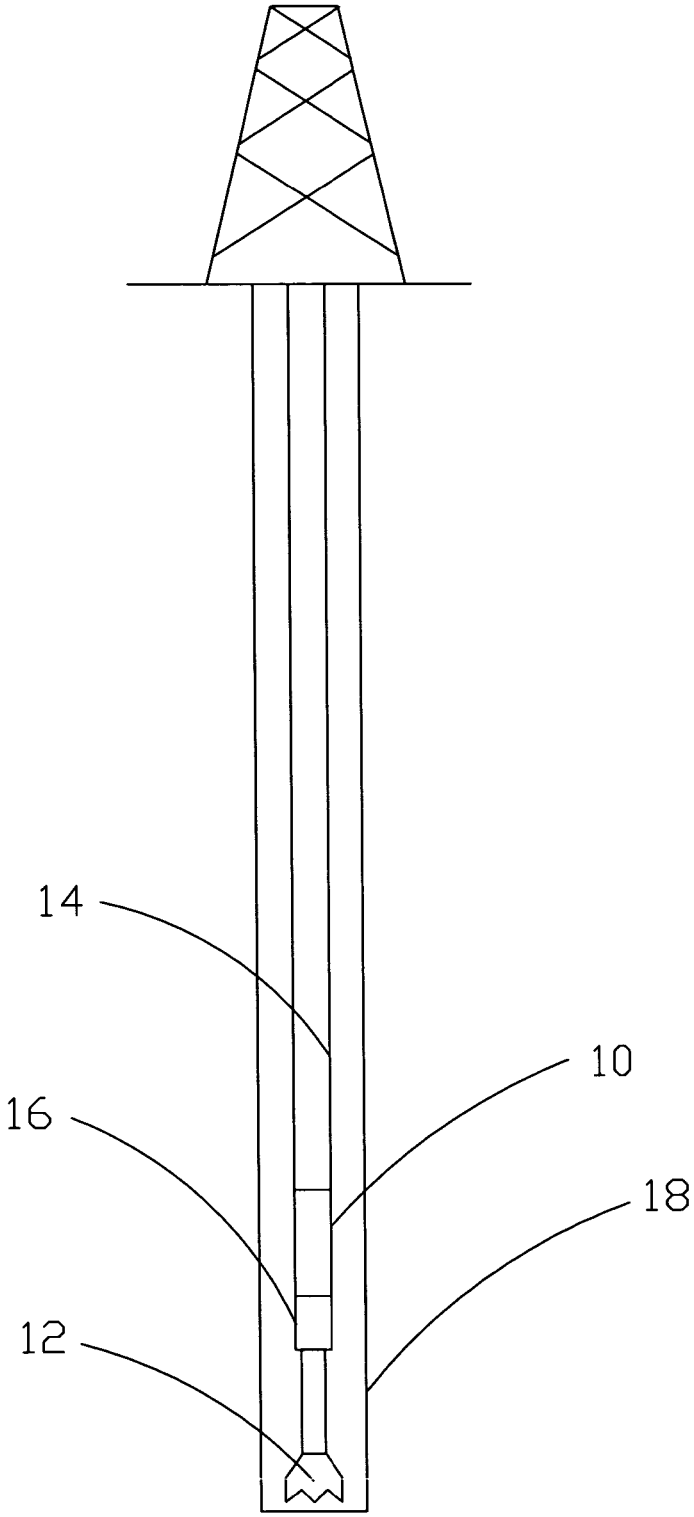
FIG. 2 is an elevational view, in cross-section, of the rotational control assembly of FIG. 1 positioned in a drill string in accord with one possible embodiment of the present invention.

Referring now to the drawings, and more particularly to FIG. 1 and FIG. 2, there is shown downhole rotational control assembly 10 which may be utilized for well drilling, earth boring, and/or for other purposes that require the drill string to transfer torque, typically to the bottom hole assembly and the drill bit. While a specific embodiment of rotational control system 10 is provided herein, rotational control assembly 10 could also include any mechanism that is operable to connect and disconnect torque between shafts or drilling tubulars to eliminate torsional oscillations and thereby control torsional energy in the drill string. Accordingly, rotational control assembly 10 may comprise an on-off clutch which enables two rotating shafts and/or two drilling tubulars and/or a drilling tubular and the drill bit to be substantially or completely connected (engaged) for torque transfer but may also be substantially or completely disconnected (disengaged) for little or no torque transfer. In a preferred embodiment, rotational control assembly 10 is either substantially fully engaged for fully disengaged, however, the present invention also contemplates partial engagement as might correspond roughly to a fluid drive or automatic transmission in a vehicle for which at least one example is provided hereinafter.

Rotational control assembly 10 may be utilized for drilling whereby rotational energy to rotate the drill bit is produced and applied to the drill string at the surface, e.g., rotary drilling, or for use with a mud motor whereby rotational energy to rotate the drill bit is applied downhole closer to the drill bit. Moreover, while rotational control assembly 10 is shown in FIG. 1 as a stand-alone assembly, it is also contemplated that rotational control assembly 10 may be incorporated into other downhole mechanisms, such as for instance, a down hole mud motor.

When an increase in torque occurs the drill bit speed (RPM) is reduced, and the drill string windup or torsional potential energy increases. Rotational control assembly 10, in one preferred embodiment, might be referred to an anti-accelerator sub because in one presently preferred embodiment assembly 10 is activated in response to excessive acceleration of the drill bit in order to stop slip-stick (stick-slip) and bit bounce in vertical, directional and horizontal wells by reducing or eliminating the harmonic cycles or oscillations that occur with velocity or RPM changes. However, the present invention is not limited to this embodiment and may also be responsive to limit RPM and/or to activate based on acceleration but before a selected RPM is reached and/or for any desired type of movement of the bit including bit whirl or any other type of drill bit movement.

In operation of rotational control 10, when the drill bit, such as drill bit 12 as shown in FIG. 2 starts to accelerate, rotational control assembly 10 releases or disengages between upper tubular and/or upper drilling string 14 and lower tubular or lower drilling string 16, or bottom hole assembly 18, and/or drill bit 12, allowing bottom hole assembly 18 and/or drill bit 12 and/or a mud motor to rotate at a different velocity or RPM (rate) than upper drill string 14, thereby releasing a variable set amount of windup (stored elastic potential energy). Rotational control assembly 10 may preferably be positioned at a lower portion of the drill string but could be positioned at any desired position in the drilling string above drill bit 12 where it is desired to release torsional energy. Moreover, if desired, additional rotational control assemblies 10 may be utilized in more than one position in the drill string.

Rotational control assembly 10 operates during drilling and may typically release for only short moments or for selected amounts of relative rotation between, for instance, upper tubular 14 and lower tubular 16. The short release time insures that not all the energy that is required for constant torque (speed) is lost due to the complete unwinding of the drill string. The release may be programmed to occur each time there is an increase in change of bit rotational velocity or RPM or both over the variable set amount, to return the BHA and/or drill bit to a constant velocity or RPM, which is most desirable for highly efficient drilling. In other words, in one presently embodiment, rotational control assembly 10 is responsive to bit rotational acceleration. However, if desired rotational control assembly 10 could also be made to respond to bit rotation velocity and/or changes in acceleration. In a presently preferred embodiment, it may be desirable to respond to acceleration changes prior to reaching the drilling driving rotational speed to thereby release greater amounts of torque prior to the rotational speed becoming too great. For instance, if the bit stops due to encountering a different formation, the torque in the drill string will build up until the torque on the bit is large enough to overcome the resistance whereby the bit RPM will begin to accelerate. In the presently preferred embodiment, the release will occur before the bit reaches the average rotational RPM. Thus, rotational control assembly 10 responds within milliseconds after detecting excessive acceleration of the bit to act before the bit reaches the average rotational RPM to thereby release the excessive torque in the drill string.

The sensors, such as an accelerometer, for rotational control assembly 10 are preferably provided within the same housing as used by rotational control assembly 10 but could also be mounted elsewhere, such as in the bit. For instance, rotational control assembly 10 could be activated in response to signals, such as acoustic or mud wave signals sent from the bit or control signals sent from the surface. In another less desired embodiment, rotational control assembly 10 may simply be activated at selected moments automatically or at set intervals so that no sensor is required at all.

In a presently preferred embodiment, rotational control assembly 10 works on the principal of monitoring an increase in acceleration or RPM which indicates the beginning of harmful rotational oscillations. The acceleration or RPM measurement for releasing can be effected by accelerometers, electrical/electronic sensors, hydraulic flow valves, acoustic sensors, mechanical cams, and/or any other suitable means. The required amount or time of release can be controlled by electrical circuits such as programmable logic controllers (PLC), as shown in system 100 in FIG. 11, or hydraulic metering units or mechanical cams. The locking/unlocking of rotational movement between upper drill string section 20 and lower drill string section 22 can be effected by controlling hydraulic oil flow from radial or axial pistons moved by mechanical cams, concentric, eccentric or crankshaft type drives of the type shown in some detail in system 100 of FIGS. 11, 12, and 13. Upper drill string section 20 could comprise a tubular in the drilling string, a mud motor, the bottom hole assembly or the like. Lower drill string section 22 could comprise another tubular in the drilling string, a mudmotor, the bottom hole assembly, the bit, or the like.

In FIG. 1, radially oriented pistons 24 are utilized for locking/unlocking camshaft mandrel 26, but as discussed above, other locking/unlocking mechanisms could also be utilized. Camshaft mandrel 26 is rotatable but axially affixed with respect to upper housing 34 by utilizing camsnaft retaining nut(s) 50, axial-radial bearing 37, and bearing journals 38, 39, and 40. Camshaft mandrel 26 is affixed to or may be an integral part of lower housing 36. Thus, if camshaft mandrel 26 is locked by radially oriented pistons 24 as discussed hereinafter, then both upper housing 34 and lower housing 36 must rotate together. If camshaft mandrel 26 is unlocked by radially oriented pistons 24, then upper housing 34 and lower housing 36 may rotate with respect to each other, thereby releasing potential torque energy stored in the drill string.

Figure 3:
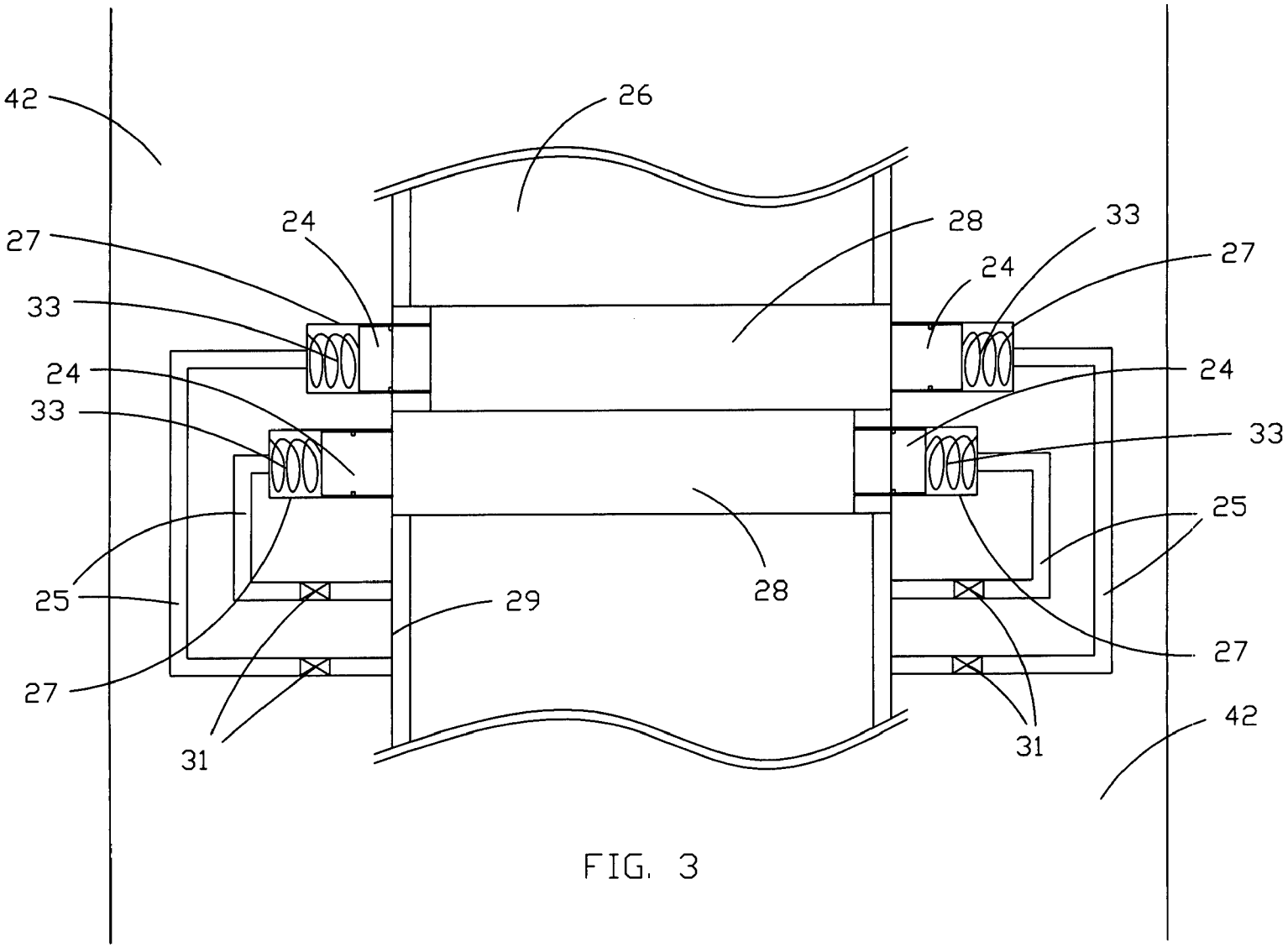
FIG. 3 is an enlarged elevational view, in cross-section, of a portion of a clutch assembly for a rotational control system in accord with the present invention.
Figure 11:
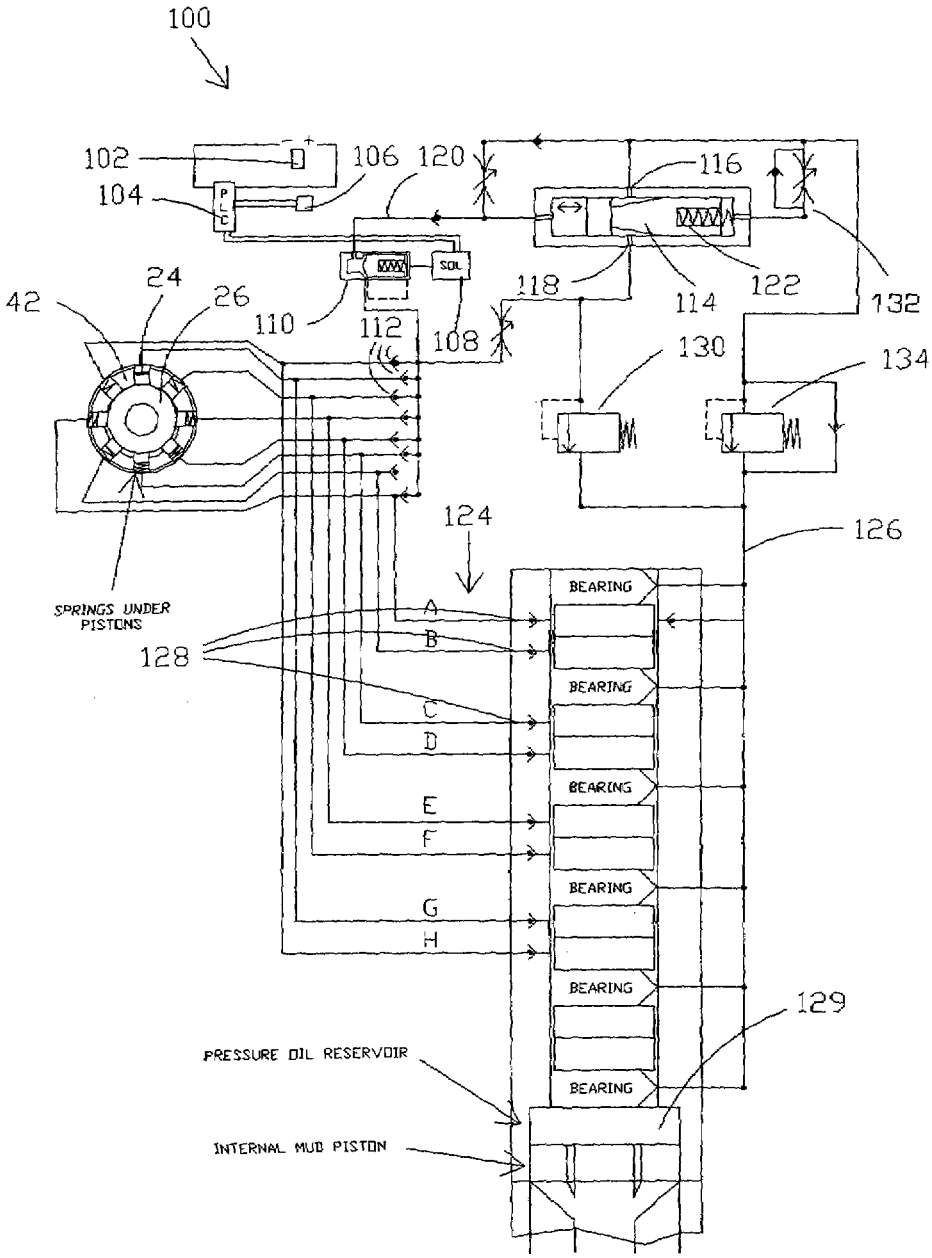
FIG. 11 is a schematic diagram showing a fast response downhole clutch with hydraulic control system for a rotational control in accord with the present invention.
Figure 12:
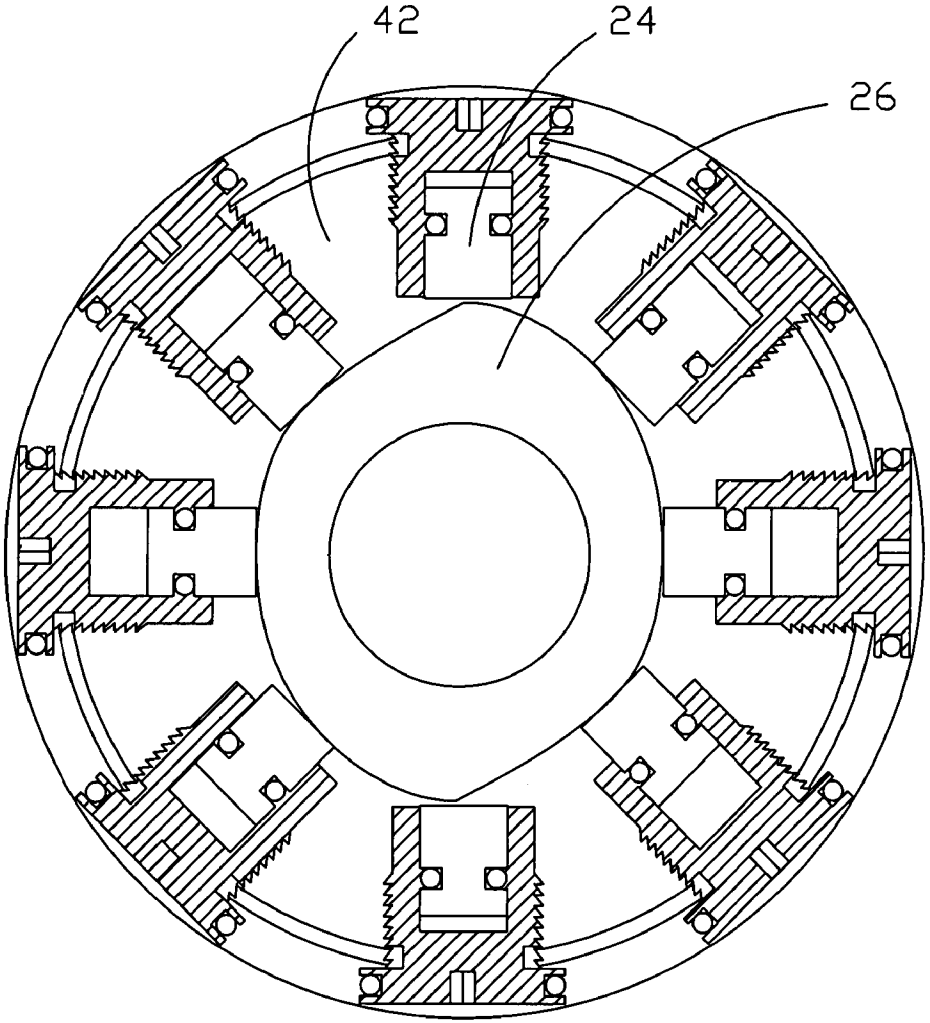
FIG. 12 is an elevational view, in cross-section, showing an enlarged cross-section one piston/cam section of the type shown in FIG. 11 for a fast acting clutch in accord with the present invention.
Figure 13:
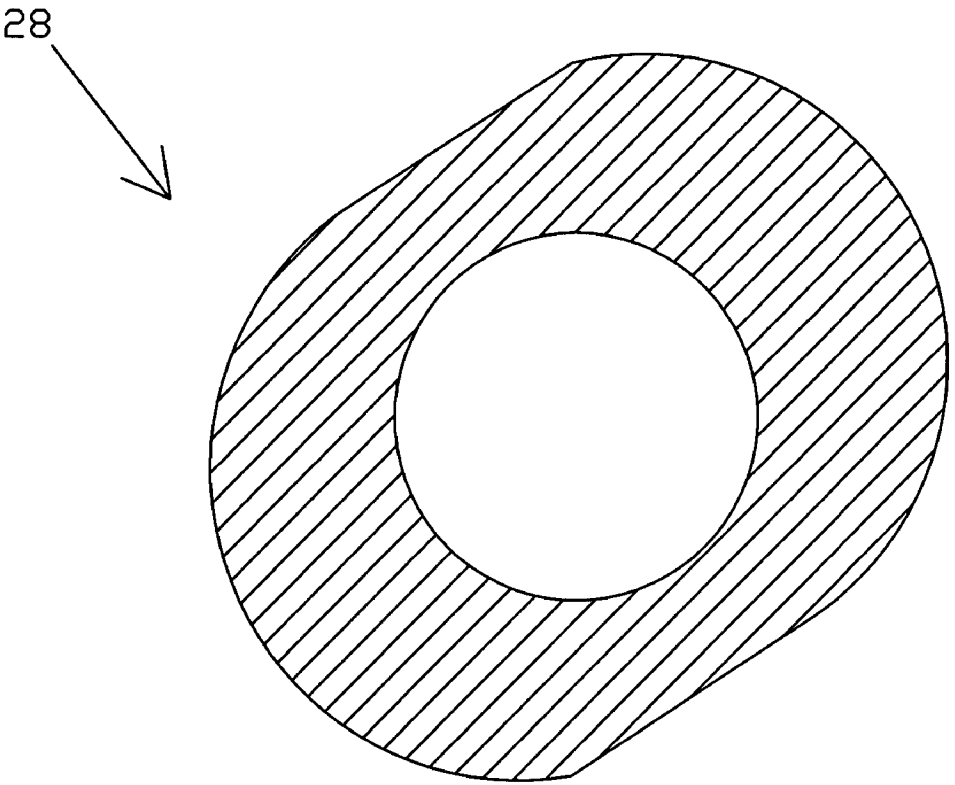
FIG. 13 an elevational view, in cross-section, of a cam for the fast acting clutch in accord with the present invention.

A generalized example of a locking mechanism utilizing camshaft mandrel 26 and radially oriented pistons 24 is shown in more detail in FIG. 3, and a presently preferred embodiment is shown in FIG. 11, FIG. 12, and FIG. 13. In FIG. 3, oil flow paths 25 are provided from cylinders 27, within which radially oriented pistons 24 are positioned, and continue back to hydraulic oil chamber 29 in which cam shaft mandrel 26 is positioned. Pistons 24 are biased radially inwardly by springs 33 so when valves 31 are open, then they follow cam lobes 28 because pistons 24 are then free to move. When valves 31 are open then radially moveable pistons 24 are free to move because hydraulic oil is free to flow through oil flow paths 25. Accordingly, with valves 31 open, springs 33 cause radially pistons 24 to follow cam lobes 28 inwardly and outwardly as the camshaft mandrel rotates within camshaft/piston housing 42. Thus, when valves 31 are open, camshaft 26 is free to rotate with respect to camshaft/piston housing in which radially oriented pistons 24 are mounted. When valves 31 are closed, then radially oriented pistons are fixed in position and therefore lock with camshaft 26 so camshaft/piston housing 42 and camshaft 26 are effectively locked together.

Valves 31 may also be variable to variably control the amount of torque transmitted between upper drilling section 20 and lower drilling section 22. Thus, a wide range of operation for rotational control is conceivable in accord with the present invention so that longer term rotational oscillation damping may be utilized for rather than simply on/off control for short bursts.

In a presently preferred embodiment, a PLC based control with electronic accelerometers may be mounted in electronics/hydraulic/power supply enclosure 44 and may be utilized for measuring the increase in acceleration or RPM. The amount of release between upper housing 34 and lower housing 36, in terms of rotational position change and/or time, may be controlled by the PLC. The rotational distance or time of release may be a variable amount or a fixed amount based on programming in response to signals from embedded sensors for velocity, RPM, relative rotational position or speed, and/or changes in the velocity such as acceleration and/or changes in acceleration and/or in response to bit whirl or any other type of detectable bit or drill string motion. The release may be accomplished by allowing hydraulic oil to flow through piston chambers 27 in which radial pistons 24 are then radially moveable. Radial pistons 24 are engageable with multiple eccentric cams 28 on camshaft mandrel 26. Radial pistons 24 are mounted in camshaft/piston housing 42 which in turn may be threadably affixed to upper housing 34 which in turn may be threadably secured to upper drill string portion 20. Valves 31 may be controlled with the PLC control and actuators which may preferably be mounted in housing 28. The PLC sensors preferably measure the amount of difference in rotation and/or time of release between the released rotating upper drill string section 20 and lower drill string section 22.

In a preferred embodiment of a method of operation of rotational control assembly 10, the BHA and/or drill bit may not actually stop rotating while the release or slippage between upper housing 34 and lower housing 36 occurs. See FIG. 4-5 for possible examples. However, the rate of rotation of the drill bit is controlled to prevent the excessive acceleration of the bit that occurs with torsional oscillations. When the predetermined amount of release is measured electronically, or a predetermined time has elapsed, e.g., 150 milliseconds, radial pistons are locked in place against the eccentric cams 28 by closing valves 31. The desired movement of radial pistons 24 may be accomplished with valves, actuators, and the like. When radial pistons are locked against radial movement in engagement with cam shaft mandrel 26, then high torque is transmitted between upper drill string section 20 and lower drill string section 22 as may be required to drive bottom hole assembly 18 and/or drill bit 12.

The hydraulic oil supply preferably has an accumulator volume within housing 42 that ensures a constant volume of oil. In a preferred embodiment, this hydraulic oil is self-contained and does not require motors or pumps. If desired, the PLC can be pre-programmed or may have real time logic or programming changes received from an external source located at the surface (drilling rig floor), from MWD and LWD logging tools located in the drill string, from the bit itself due to signals transmitted therefrom, or other sources.

In a presently preferred embodiment, the complete rotational control assembly 10 comprises three or more tubular sections as indicated in FIG. 1, including upper housing 34, lower housing 36, and camshaft/piston housing 42. The electrical, hydraulics can be mounted in any section with alternate designs.

The preferred design allows for all the electrical, PLC, sensors and hydraulic actuators to be located in housing 44 as shown on the drawings. Lower housing 36 is secured to camshaft mandrel 26 by any suitable means, such as a threaded connection or any other type of mechanically secure connection or may be an integral part thereof. One end of lower housing 36 utilizes seal areas 46 and 48 for sealing with the piston/camshaft tubular housing 42 which contains radially oriented pistons 24 and hydraulic oil. The lower end has an API pin thread that allows the sub to be used in a standard drill string such as by threadably connecting with lower drilling string section or tubular 22.

Upper housing 34 preferably has an API threaded box 52 to provide a standard connection with upper tubular 20. Below threaded box is a hollow area or recess for camshaft upper retaining nut or nuts 50, which are utilized to axially secure camshaft mandrel 26 to upper housing 34 while permitting rotation therewith. Retaining nut or nuts 50, locks axial-radial thrust bearing 37 onto camshaft mandrel 26 and will not allow the complete axial or radial separation between the upper housing 34 and lower housing 36 when camshaft mandrel 26 is released for rotational adjustments of velocity, rotational position, acceleration, and/or RPM increases. The opposite end of upper housing 34 from box 52 utilizes pin thread 54, which joins to the inside of the camshaft/piston housing 42. The area between the threaded ends contains seals 56, which seal around camshaft mandrel 26 to seal off hydraulic fluid region 29 discussed hereinbefore.

Lower housing 36 has seal area 48 for sealing with camshaft/piston section 42. An additional hollow sealed area radially outwardly of lower housing 36 comprises electronics/hydraulics control/power enclosure 44 which may be utilized for the installation of the electrical components, including the PLC, as well as the hydraulic actuators and sensors. The opposite (upper) end of lower housing 36 is camshaft mandrel 26. As discussed above, camshaft mandrel 26 has eccentric cam lobes 28 that have been hardened and ground. Each cam section preferably has two or more lobes 28. Concentric bearing areas are preferably provided with bearing journals, which may be similar to bearing journals 38, 39, 40, for radial support between each cam section. The upper camshaft mandrel end 58 of camshaft mandrel 26, may preferably have a threaded area for connection with retaining nuts 50 and axial-radial bearing. Upper end 58 of camshaft mandrel 26 also has a ground surface area for the box section seals 56. All internal areas are sealed from the inside and outside.

As discussed above, camshaft/piston housing 42 contains radially oriented pistons 24 and sealed hydraulic fluid region 29 around camshaft mandrel 26. Camshaft/piston housing 42 connects with pin threads 54 on one end and has seals 46 and 48 on the opposite end. Camshaft/piston housing 42 is assembled onto rotational control assembly 10 prior to camshaft retaining nuts 50 and axial-radial thrust bearing 37. When upper housing 34 is attached to camshaft/piston housing 42, shoulder 60 secures axial-radial thrust bearing 37 onto the camshaft mandrel, thus locking all components together to create the completed rotational control assembly 10. The rotational control assembly 10 is filled with fluid and tested after assembly.

Figure 4:
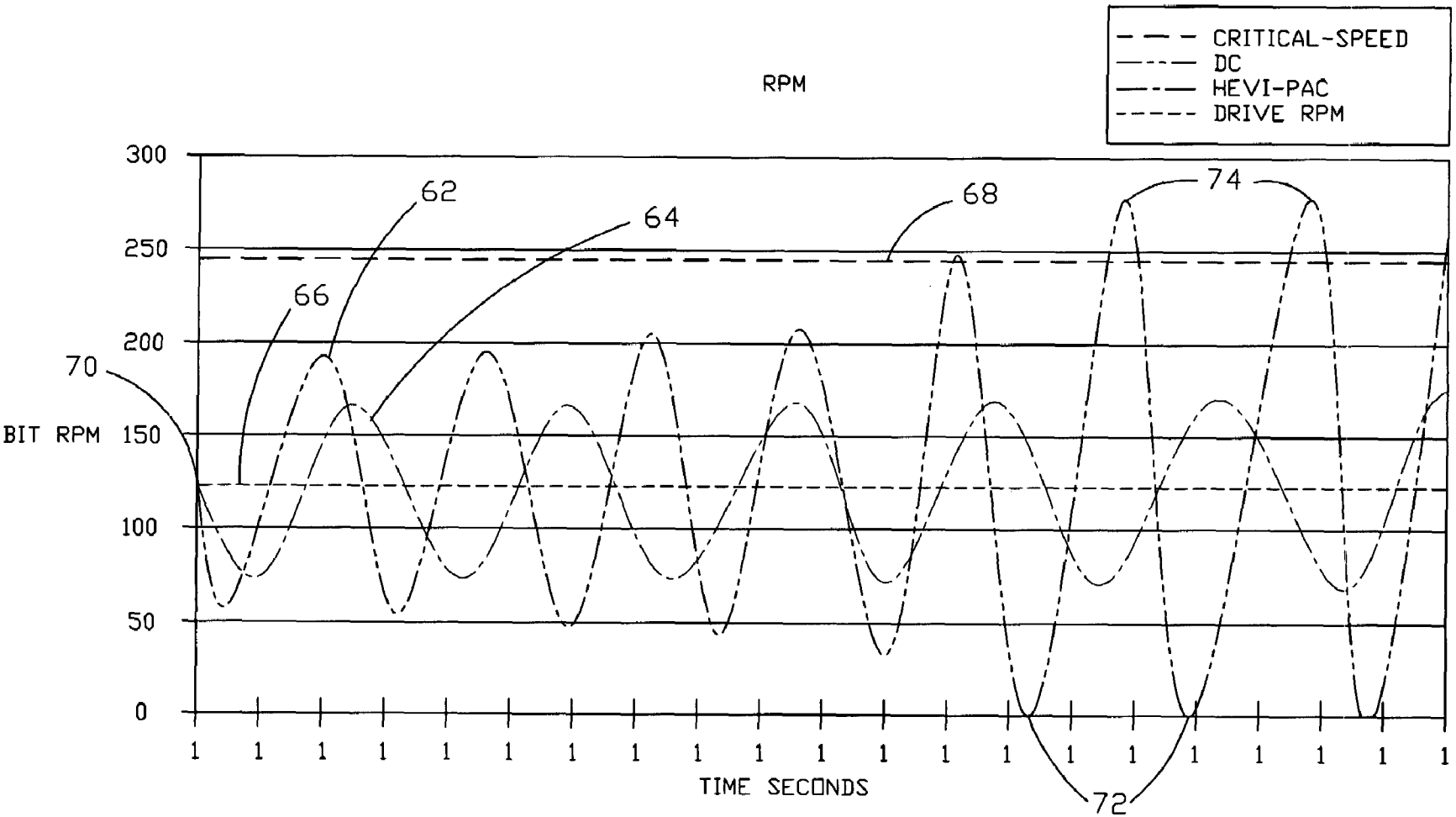
FIG. 4 is a schemmatical of a computer output showing torsional oscillation of two different types of bottom hole assemblies in a computer simulation in accord with the present invention.
Figure 5:
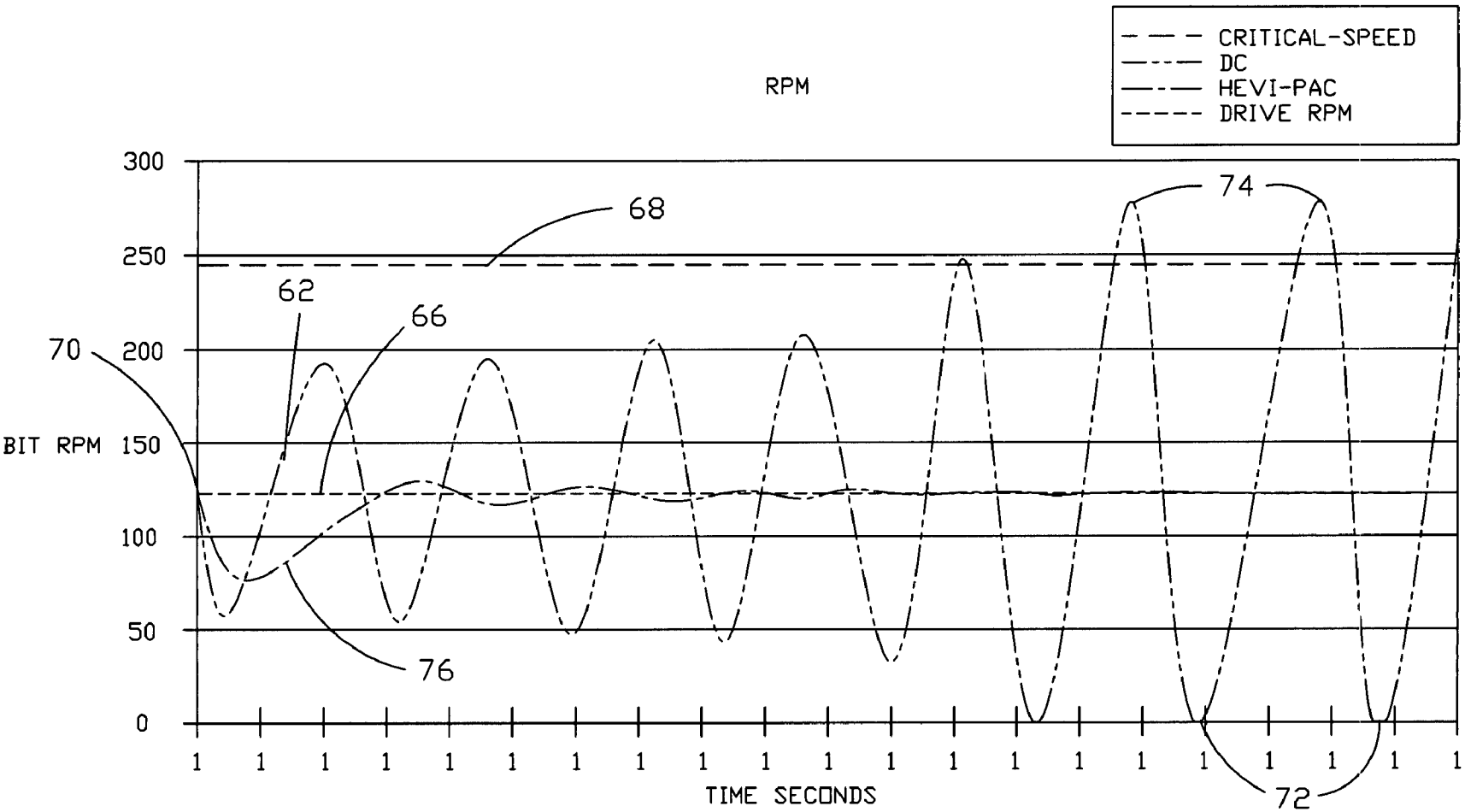
FIG. 5 is a schemmatical of a computer output showing the effect of a torsional control in accord with the present invention in stopping oscillation of one of the two different types of bottom hole assemblies of FIG. 5 in a computer simulation.
Figure 6:
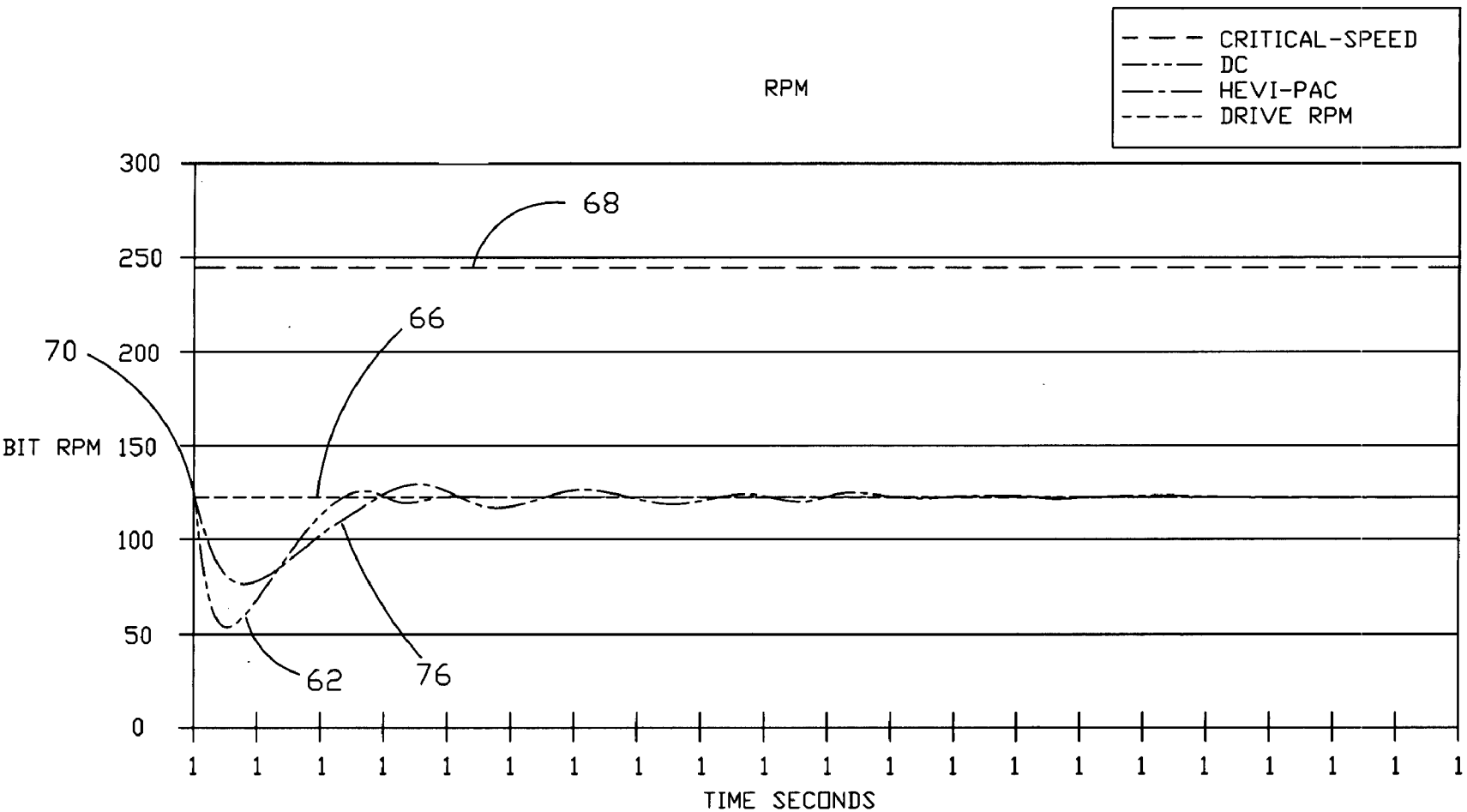
FIG. 6 is a schemmatical of a computer output showing the effect of a torsional control to stop torsional oscillations in accord with the present invention for both of the two different types of bottom hole assemblies of FIG. 5 in a computer simulation.

FIG. 4, FIG. 5, and FIG. 6 provide a few examples of operation of two simulated drill strings in accord with an embodiment of a computer simulation which can be utilized to simulate torsional oscillations of the drilling string. All details of the type of pipe, rates of drilling speed, and virtually any drilling parameter may be input into the program to see the effect. The entire drill string can be built component by component. As well, the various types of drag and so forth can be input. A few example input screens for the simulation are seen in FIG. 7, FIG. 8, FIG. 9, and FIG. 10. FIG. 7 shows the possibility of inputting two or more different drill strings simultaneously so that the various effects can be compared depending on the drill string composition. FIG. 8 shows the inputting of the bottom hole assembly, mud weight, and many other factors. FIG. 9 and FIG. 10 shows that individual pipes can be input or selected for the simulated drill string from a wide variety of drill pipe so that any desired configuration can be simulated.

The computer software utilizes equations to simulate drill string operation and includes software control means for determining what happens when variables such as the slippage utilizing assembly 10 is applied. The simulation input may include use of variable amounts of slippage and time durations of slippage may be utilized that correspond to any type of clutch mechanism. As well, all the parameters related to torsional energy can be inserted such as the drill string length, size, rotational drive, formation variations, and so forth.

FIG. 4 shows the effect of bit speed oscillations initiated at time point 70 with a selected torque change in two identical drilling strings but with different bottom hole assemblies. Curve 62 shows the rotational speed of the drill bit (but could show rational speed of drill collars or other parts of the drilling string) and the effect on rotational speed when utilizing a standard bottom hole assembly (BHA) with heavy weight drill collars upon application of a 600 ft pound change in torque, as might simulate drilling into a different formation or other downhole torque change situations which could precipitate torsional oscillations at time point 70. Curve 64 shows the same effect the application of a 600 ft pound change of torque has on the bit speed where the improved drilling collars as per U.S. Patent Application No. 60/442,737, wherein the weight is positioned just above the drill bit. It can be seen by comparing curve 64 and curve 62 that significant improvement in reducing bit speed oscillations is obtained by use of the improved drilling collars but that torsional oscillations still occur. The drilling driving speed is shown as about 125 RPM and is indicated on the graph as curve 66. Curve 68 is the critical speed of the drill string as per API standards. Damage to the drill string is likely when rotational speeds exceed the critical speed.

Upon application of the torque change of 600 foot pounds at time point 70, the bit slows down for both types of drilling strings. In the case of the standard drilling string, oscillations begin and then actually build up to the point where the drill bit actually is stopping for moments as indicated at 72, i.e., full blown slip-stick. After winding up, the drill bit then accelerates to speeds over the critical speed of the drill string as indicated at 74. Thus, damage to the drill string is likely for the standard drill string.

The improved drilling collars are more resistant to torsional oscillations and do not build up as does the standard drilling string BHA but the drill bit does continue to have torsional oscillations under this scenario.

In FIG. 5, the effect of the torsional control is shown for the improved drilling collars. The torsional control assembly 10 senses excessive acceleration and is activated in the general time as indicated by time point 76 to thereby permit slippage and release the torsional energy. In one presently preferred embodiment, it is desirable to permit slippage before the bit speed reaches the drive speed, as indicated at 66, to thereby release more energy from the drill string. Waiting until the bit speed reaches higher speeds may not be effective for damping torsional oscillations. As can be seen, the effect of permitting slippage is to damp out the torsional oscillations completely within a few cycles. Torsional control assembly 10 thus provides a fast acting clutch which can sense acceleration and then release in a short time frame such as ten to fifty milliseconds.

In FIG. 6, the effect of torsional control is shown for both the standard BHA drill string and the drill string with improved drilling collars. Thus, torsional control assembly 10 senses excess acceleration and is activated in the general region of time point 76. The result is that the torsional control causes either type of drilling string to dampen the torsional oscillations to zero within a few cycles. In other words, by application of slippage at the time indicated at 76, torque is released from the drill string so that the bit does not accelerate and decelerate wildly as occurs during slip-stick operation.

FIG. 11 shows control system 100 to sense acceleration and operate to release torsion in the drill string. In system 100, battery pack 102 supplies power to programmable logic circuit (PLC) 104, accelerometer 106, and solenoid 108. PLC 104 is programmed to activate solenoid 108 when excess acceleration is detected. Prior to operation of solenoid 108, cam shaft mandrel 26 is locked to piston/camshaft tubular housing 42 (see FIG. 11 and enlargement FIG. 12), so that the drill string 14 is locked to the drill bit 12, as discussed in relationship to FIG. 1 and FIG. 2. Prior to operation of solenoid 108, radial pistons 24 are prevented from movement due to hydraulic fluid which, as discussed above, is not compressible. Spool 114 is all the way to the left prior to operation of solenoid 108, and blocks fluid flow through ports 116 and 118. The other flow path of fluid flow through piston circuits 124 (piston circuit A, B, C, D, etc.) is blocked by one-way valves 128. Thus, pistons 24 lock cam shaft mandrel 26.

In one preferred embodiment, there may be numerous cam sections with a total of from one hundred fifty to two hundred radial pistons. FIG. 12 shows one cam section with eight radial pistons 24.

Solenoid 108 operates pilot or control valve 110. When control valve 110 opens then hydraulic fluid may flow through line 120 to thereby move spool 114 to the right by overcoming the biasing force produced by spool spring 122. Note that in one embodiment spool 114 is tapered to permit a gradual opening/closing. When spool 114 moves the to right, this opens a flow path between ports 116 and 118 thereby permitting hydraulic fluid to flow through one-way valves 112 past shuttle 122 through line 126, and into hydraulic reservoir 129. Fluid flow can then proceed back to radial pistons 24 through one-way valves 128. Thus, cam shaft mandrel 26, which may be connected to the drill bit, is free to rotate with respect to piston housing 42, which may be connected to the drill string.

When PLC determines it is time to stop slippage, then solenoid 108 is deactivated thereby reducing the pressure at line 120 and causing spool 122 to move to the left to close off ports 116 and 118. The entire process of releasing and clamping of cam shaft mandrel 26 may take place very quickly. For instance, in one embodiment, after detection of excessive acceleration by PLC 104, the cam shaft may be released within five to fifty milliseconds, and typically in the range of about ten milliseconds. In one embodiment, a fixed time period may be utilized, such as one hundred fifty milliseconds or other suitable time period, whereupon cam shaft mandrel 26 is then locked with respect to housing 42. If necessary to eliminate oscillations, then the process will be activated again in another subsequent cycle of RPM oscillations. However, PLC could be programmed to respond to decreased acceleration, or the like, as desired.

Torque limiting valve 130 may be utilized to limit the amount of torque transferred between cam 26 and housing 42 to avoid damaging the components thereof as may occur with very large torques. Other control limiting elements, such as for example, valves 132 and 134 may or may not be present as per design criteria.

FIG. 12 provides an enlarged cross-sectional view with respect to the tubular axis of radial pistons 24 within housing 42 which engage cam shaft mandrel 26. FIG. 13 provides an enlarged cross-sectional view of cam shaft mandrel 26.

The foregoing disclosure and description of the invention is therefore illustrative and explanatory of a presently preferred embodiment of the invention and variations thereof, and it will be appreciated by those skilled in the art, that various changes in the design, manufacture, layout, organization, order of operation, means of operation, equipment structures and location, methodology, the use of mechanical equivalents, as well as in the details of the illustrated construction or combinations of features of the various elements may be made without departing from the spirit of the invention. For instance, the present invention may also be effectively utilized in coring as well as standard drilling. The relative components may be inverted in the drill string. Moreover, the present construction may be utilized in other tools and for other purposes.

In general, it will be understood that such terms as "up," "down," "vertical," "right," "left," and the like, are made with reference to the drawings and/or the earth and that the devices may not be arranged in such positions at all times depending on variations in operation, transportation, mounting, and the like. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. Thus, various changes and alternatives may be used that are contained within the spirit of the invention. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative of a presently preferred embodiments and not in a limiting sense.

What is claimed is:

1. A method for controlling rotational oscillations of a drill bit while drilling, said drill bit being mounted to a drilling string, said drilling string comprising a plurality of interconnected tubulars, comprising:

installing a rotational control assembly in said drilling string between a lower tubular of said drilling string and an upper tubular of said drilling string;

selectively transferring torque between said upper tubular portion of said drilling string and said lower tubular of said drilling string during a drilling operation; and selectively permitting rotational slippage between said upper tubular of said drilling string and said lower tubular of said drilling string during said drilling operation in a manner which dampens or stops said rotational oscillations; and subsequently automatically controlling the transfer of torque between said upper tubular portion of said drilling string and said lower tubular of said drilling string for continuing said drilling operation.

2. The method of claim 1, further comprising activating said rotational control assembly to permit said rotational slippage in response to a selected acceleration of said drill bit.

3. The method of claim 2, further comprising hydraulicly releasing a rotational locking mechanism for a selected predetermined time period and then subsequently locking said rotational locking mechanism.

4. The method of claim 2, further comprising activating said rotational control when a rotational speed of said lower tubular portion of said drilling string is less than a driving speed of said drilling operation.

5. The method of claim 1, further comprising providing an electronic control for activating said rotational control assembly to permit said rotational slippage.

6. The method of claim 5, further comprising programming said electronic control for a selectable amount of said rotational slippage.

7. The method of claim 1, further comprising controlling movement of one or more hydraulic pistons.

8. An assembly for permitting rotational slippage between a lower portion of a drill string and an upper tubular of said drill string while drilling with a drill bit to thereby release torsional energy from said drill string, said assembly comprising:

a tubular housing for connecting between said lower portion of said drill string and said upper portion of said drill string;

one or more moveable members within said tubular housing for controlling torque transfer between said lower portion of said drill string and said upper portion of said drill string;

one or more sensors for sensing information related regarding torsional oscillations of said drill bit; and a control for controlling said one or more moveable members in a manner which dampens or stops said rotational oscillations.

9. The downhole apparatus of claim 8, wherein said control operates to dampen or stop said rotational oscillations without manual intervention.

10. The downhole apparatus of claim 9, wherein said one or more sensors are sensitive to an amount of acceleration movement of said drill bit.

11. The downhole apparatus of claim 9, wherein said control is operable for a cycle of unlocking to permit relatively free rotation between said lower portion of said drill string and said upper portion of said drill string, and then locking to prevent rotation between said lower portion of said drill string and said upper portion of said drill string within a time period of from about fifty milliseconds to less than one second.

12. The downhole apparatus of claim 8, wherein said one or more moveable members comprise one or more pistons.

13. The downhole apparatus of claim 8, wherein said one or more moveable members comprise hydraulic pistons and one or more valves for controlling movement of said hydraulic pistons.

14. A method for controlling drill bit oscillations of a drill bit while drilling, said drill bit being mounted to a drilling string, said drilling string comprising a plurality of interconnected tubulars, comprising:

installing a clutch assembly in said drilling string between a lower tubular of said drilling string and an upper tubular of said drilling string;

selectively engaging said clutch to transfer torque between said lower tubular portion of said drilling string and said upper tubular of said drilling string during a drilling operation; and selectively disengaging said clutch to permit slippage between said upper tubular of said drilling string and said lower tubular of said drilling string during said drilling operation to thereby dampen said drill bit oscillations.

15. The method of claim 14, further comprising sensing movement of said drill bit which indicates said drill bit oscillations are likely to occur.

16. The method of claim 15, wherein said sensing movement further comprises sensing acceleration.

17. The method of claim 16, further comprising sensing a selected acceleration and disengaging before a selected rotational velocity is reached.

18. The method of claim 15, wherein said sensing movement further comprises sensing rotational velocity.

19. The method of claim 15, wherein said sensing movement further comprises sensing rotational velocity and acceleration.

20. The method of claim 14, further comprising performing said step of selectively disengaging in response to said sensing.

21. The method of claim 20, wherein said step of engaging or disengaging further comprises selectively partially disengaging or selectively partially engaging said clutch to permit some slippage and also to transfer some torque but not all torque.

22. An assembly for permitting short periods of rotational slippage between a lower portion of a drill string and an upper tubular of said drill string while drilling with a drill bit, said assembly comprising:

a tubular housing for connecting between said lower portion of said drill string and said upper portion of said drill string;

one or more moveable members within said tubular housing for controlling torque transfer between said lower portion of said drill string and said upper portion of said drill string; and a control for controlling said one or more moveable members, wherein said control is operable for a cycle of unlocking for permitting rotation between said lower portion of said drill string and said upper portion of said drill string and then locking for preventing rotation between said lower portion of said drill string and said upper portion of said drill string within a time period of from about fifty milliseconds to less than one second to thereby dampen or stop bit oscillations.

23. The downhole apparatus of claim 22, further comprising one or more sensors for sensing a selected type of movement of said drill bit for use by said control to thereby dampen or said stop bit oscillations.

24. The downhole apparatus of claim 23, wherein said one or more sensors are sensitive to a selected acceleration of said drill bit.

25. The downhole apparatus of claim 22, wherein said one or more moveable members comprise one or more pistons.

26. The downhole apparatus of claim 22, wherein said one or more moveable members comprise hydraulic pistons and further comprising one or more valves for controlling movement of said hydraulic pistons.

* * * * *

UNITED STATES PATENT AND TRADEMARK OFFICE

CERTIFICATE OF CORRECTION

PATENT NO. : 6,997,271 B2
APPLICATION NO. : 10/849624
DATED : February 14, 2006
INVENTOR(S) : Richard A. Nichols et al.

It is certified that error appears in the above-identified patent and that said Letters Patent is hereby corrected as shown below:

Column 2,
Line 31, delete “mouse” and replace with -- modes --.

Column 8,
Line 55, delete “camsnaft” and replace with -- camshaft --.

Signed and Sealed this

Twenty-seventh Day of June, 2006

JON W. DUDAS
*Director of the United States Patent and Trademark Office*

UNITED STATES PATENT AND TRADEMARK OFFICE

CERTIFICATE OF CORRECTION

PATENT NO. : 6,997,271 B2
APPLICATION NO. : 10/849624
DATED : February 14, 2006
INVENTOR(S) : Richard A. Nichols et al.

It is certified that error appears in the above-identified patent and that said Letters Patent is hereby corrected as shown below:

Claim 23, Column 16, line 30, delete " said stop" and replace with –stop said–.

Signed and Sealed this

Eighth Day of August, 2006

JON W. DUDAS
*Director of the United States Patent and Trademark Office*